US005785230A

United States Patent [19]

Davignon et al.

[11] Patent Number: 5,785,230

[45] Date of Patent: Jul. 28, 1998

[54] BUTTON ATTACHING DEVICE

[75] Inventors: Paul A. Davignon, Uxbridge; Charles L. Deschenes, North Attleboro; Douglas Cooke, Charlestown; Hugh Smith, West Roxbury; William Hartman, Quincy, all of Mass.

[73] Assignee: Avery Dennnison Corporation, Pasadena, Calif.

[21] Appl. No.: 752,073

[22] Filed: Nov. 19, 1996

[51] Int. Cl.[6] ..... A43D 69/00

[52] U.S. Cl. ..... 227/71; 227/68; 227/120

[58] Field of Search ..... 227/154, 67, 68, 227/71, 120; 112/110

[56] References Cited

U.S. PATENT DOCUMENTS

| | | | |
|---|---|---|---|
| 216,895 | 6/1879 | Rollins | 227/67 |
| 1,343,289 | 6/1920 | Suchy | 227/71 |
| 3,875,648 | 4/1975 | Bone | 227/71 |
| 3,900,925 | 8/1975 | La Torraca | 24/90.1 |
| 4,316,562 | 2/1982 | Davidson et al. | 227/68 |
| 5,518,162 | 5/1996 | Deschenes et al. | 227/71 |
| 5,588,575 | 12/1996 | Davignon | 227/67 |

*Primary Examiner*—Scott A. Smith
*Attorney, Agent, or Firm*—Kriegsman & Kriegsman

[57] ABSTRACT

A button attaching device includes a top member and a bottom member which are hingedly connected together, the bottom member including an anvil. The button attaching device further includes a needle block assembly mounted on the top member. The needle block assembly includes a block of material, a pair of rodless fastener dispensing needles and a fastener. The fastener is shaped to include a foot formed at each end of a filament which can be removably mounted on one of the pair of rodless fastener dispensing needles. In one embodiment of the present invention, the needle block assembly is removably mounted on the top member and is sized and shaped so as to fit within a needle block assembly storage compartment formed in the bottom member. In another embodiment of the present invention, a plurality of needle block assemblies are interconnected to form a needle block carousel which is rotably mounted within a hollowed portion formed in the top member. The carousel comprises a mounting block rotably mounted on the top member, each of the plurality of needle block assemblies being spring mounted on the mounting block.

10 Claims, 7 Drawing Sheets

BUTTON ATTACHING DEVICE

BACKGROUND OF THE INVENTION

The present invention relates to a button attaching device and, more particularly to a hand operated button attaching device.

In U.S. Pat. No. 3,900,925 to G. A. LaTorrace there is disclosed a one piece, durable button attaching device comprising a hollow pointed needle portion having a longitudinal slot along a portion of the top thereof. The rear end of the needle is immovably mounted in a rounded handle portion or other gripping means. Angular shaped fasteners having a vertical shank with a pair of oppositely slanting legs extend an equal distance form top and bottom thereof forming approximately a 55 degree angle on one side of the shank and a 125 degree angle relative thereto on the other side.

In U.S. Pat. No. 4,281,782 to W. H. W. Marsh et al there is disclosed a button sewing device which includes a base, a pair of needles which carry collapsible thread formed loops, and project from the base for use in penetrating a layer of material and the holes of a button to be attached to the material; and with elastomeric material over the base compressible by pressure on the material to which the button is to be attached, and expandable to raise such material and thereby cause the loops to be opened above the button for receiving a thread bundle.

In U.S. Pat. No. 4,296,698 to R. D. Davidson et al. there is disclosed a button attaching hand tool comprising a box-like structure which includes a fixed and adjustable needle, and which includes a button storage compartment. A slidable shroud on the box-like structure for extricating a button and material from the needles is movable between a position in which an operator is shielded from injury by the needles and another position in which the needles are exposed for button sewing use.

In U.S. Pat. No. 4,316,562 to D. R. Davidson et al. there is disclosed a button attaching tool which includes a base, a pair of needles which have collapsible and expendable thread receiving eyes and which project from the base for use in penetrating a layer of material and the holes of a button to be attached to the material, and a member for stripping the material and button from the needles.

In U.S. Pat. No. 4,361,101 to W. H. W. Warsh et al there is disclosed a button attaching device having a bifurcated needle holding member which can be utilized to adjust the spacing between a pair of needles, and with a needle cover which attaches to the bifurcated member to protect one from injury by the needles and form a unit that can be conveniently carried on he person of a user.

In U.S. Pat. No. 5,518,162 to C. L. Deschenes et al there is disclosed a fastener attaching tool particular suited for use in attaching buttons to clothing, etc. and which is constructed for use with a fastener clip which includes a pair of runner bars and one or more U-shaped fasteners having transverse bars at opposite ends, each transverse bar being connected on its side to a corresponding runner bar by a severable connector post. The tool includes a body having a front end. A pair of needles are pivotally mounted at the front end of the body, each needle having a longitudinal slotted bore adapted to receive one of the transverse bars and a knife edge formed on one side which is adapted to a connector post from its associated transverse bar as the transverse bar is pushed through the needle. The body is shaped to include a transverse feed slot down through which the fastener clip is manually inserted. The tool also includes an ejector mechanism which is slidable mounted back and forth within the body and is rearwardly biased by a spring. The ejector mechanism is moved manually forward from the rear of the tool and includes a pair of ejector rods which are in the needles. The body includes a pair of flexible fingers which cooperate with a pair of posts on the ejector mechanism to prevent automatic return of the ejector mechanism from its forwardmost position in the body to its rearwardmost position when forward pressure on the ejector mechanism is removed.

In U.S. patent application Ser. No. 08/305,486 filed on Sep. 13, 1994 in the name of Paul A. Davignon and assigned to the assignee of this application and which is incorporated herein by reference, there is disclosed a needle for use in the rodless dispensing of plastic fasteners of the type comprising a flexible filament and a cross-bar disposed at one end of the flexible filament. In one embodiment, the needle comprises a solid elongated member terminating at its front end in a top adapted to penetrate a desired article of commerce and a chamber adapted to receive a cross-bar of a plastic fastener. The chamber includes a front end, a rear end, an open top and an open bottom. The open top, which is spaced rearwardly a distance from the tip, is appropriately sized and shaped to permit the insertion and removal of a cross-bar into and from the chamber. The front end is downwardly angled towards the tip to releasably engage the top surface of the front end of the cross-bar, and the rear end has a pair of walls intersecting a V-shape to releasably engage both the top surface and the bottom surface of the rear end of the cross-bar in such a way as prevent the cross-bar from being pulled out of the chamber through the open top when low tension is applied to the flexible filament (i.e., prior to the complete insertion of the cross-bar through the article of commerce), but, yet, so as to cause the cross-bar to be pulled out of the chamber through the open top when high tension is applied to the flexible filament (i.e. following the complete insertion of the cross-bar through the article of commerce). Accordingly, it is an object of this invention to provide a new and improved button attaching device.

It is a another object of this invention to provide a button attaching device which is hand operated and which can be carried on the person of a user.

It is a further object of this invention to provide a button attaching device which is simple in construction, contains a minimum number of parts, inexpensive to manufacture and easy to use.

SUMMARY OF THE INVENTION

A button attaching device constructed according to the teachings of this invention includes a top member, a bottom member, the bottom member including an anvil, the top member being hingedly connected to the bottom member, and a needle block assembly mounted on the top member, the needle block assembly including: a block of material, a pair of rodless fastener dispensing needles mounted on the block of material, and a fastener having a foot at each end of a filament, each foot being removably mounted on one of the pair of rodless fastener dispensing needles.

Various features and advantages of the present invention will be set forth in part in the description which follows, and in part will be obvious from the description or may be learned by practice of the invention. These embodiments will be described in sufficient detail to enable those skilled in the art to practice the invention, and it is to be understood that other embodiments may be utilized and that changes may be made without departing from the scope of the invention. The following detailed description is, therefore, not to be taken in a limiting sense, and the scope of the present invention is best defined by the appended claims.

BRIEF DESCRIPTION OF THE DRAWINGS

The accompanying drawings, which are hereby incorporated into and constitute a part of this specification, illustrate various embodiments of the invention and, together with the description, serve to explain the principles of the invention. In the drawings wherein like reference numerals represent like parts.

DETAILED DESCRIPTION OF THE PREFERRED EMBODIMENT

Figure 1:
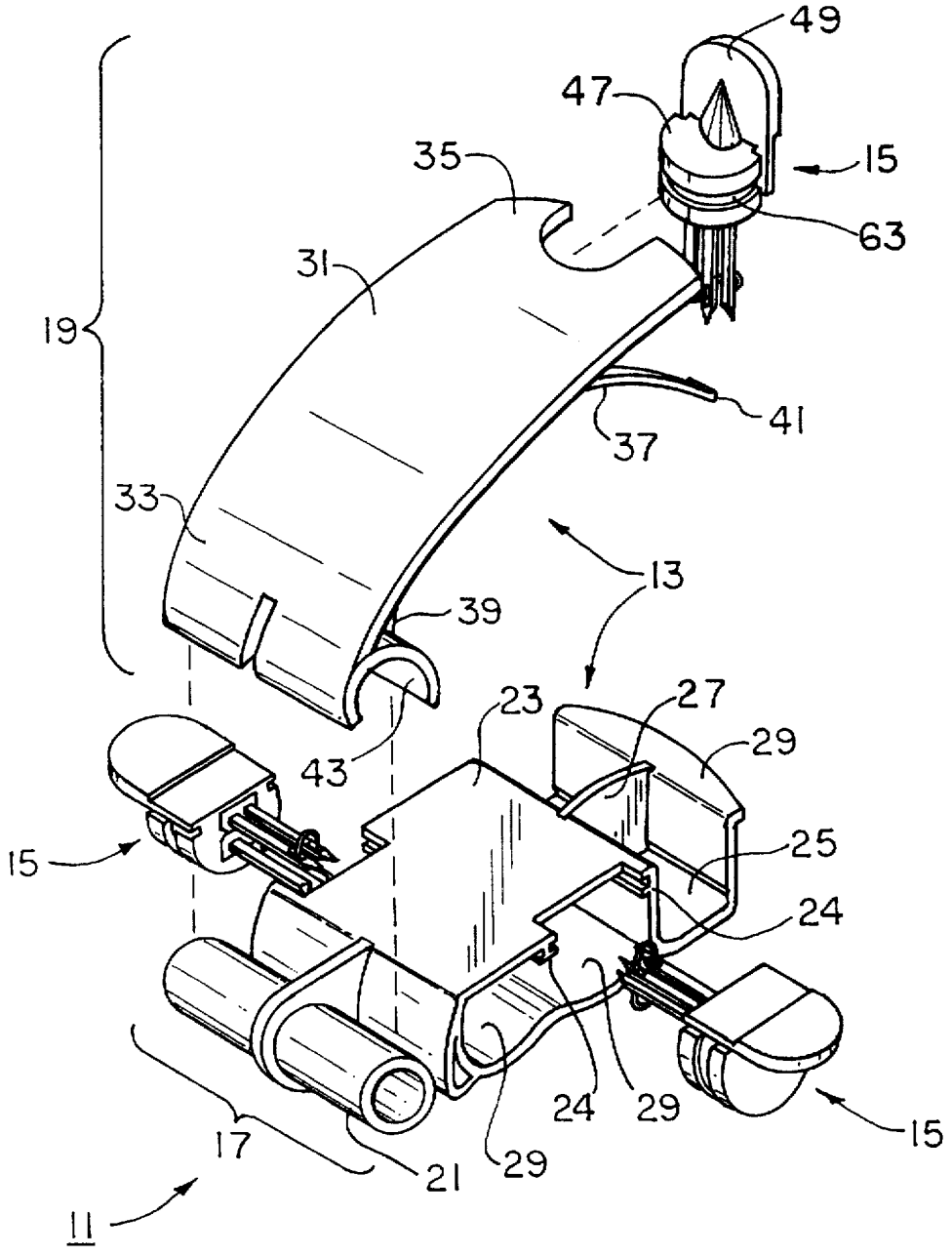
FIG. 1 is an exploded view of a first embodiment of a button attaching device constructed according to this invention for attaching a button to a piece of material.
Figure 2:
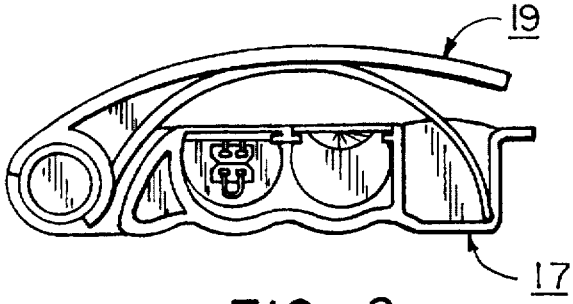
FIG. 2 is a side view of the button attaching device shown in FIG. 1, the device being shown in the closed position with the needle block assembly removed from the pivot arm.
Figure 3:
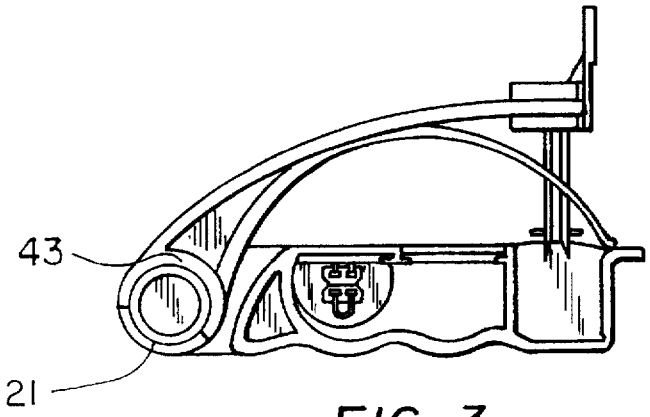
FIG. 3 is a side view of the button attaching device shown in FIG. 1, the device being shown with the spring member resting on the flange and with a needle block assembly being removed from a needle block storage compartment.

Referring now to the drawings, there are shown in FIGS. 1–8 a first embodiment of a button attaching device constructed according to the teachings of the present invention, the button attaching device being identified by reference numeral 11. As will described in detail below, button attaching device 11 can be used to secure a button B to a piece of material M.

Button attaching device 11 comprises a frame 13 and a needle block assembly 15, needle block assembly 15 being removably mounted on frame 13.

Frame 13 comprises a bottom member 17 and a top member 19, top member 19 being hingedly connected to bottom member 17. Frame 13 is preferably made of a durable plastic and can be manufactured using conventional molding techniques.

Bottom member 17 comprises an elongated cylindrical shaft 21, a hollowed out central portion 23, a generally U-shaped channel 25, an anvil 27 formed within channel 25 and a flange 29. Hollowed out central portion 23 includes a plurality of needle block assembly storage compartments 29. As will be discussed in detail below, needle block assembly storage compartments 29 are sized and shaped to enable additional needle block assemblies 15 to be temporarily stored within central portion 23 until required for use.

Top member 19 comprises a pivot arm 31 having a first end 33 and a second end 35 and an arcuate spring member 37 having a first end 39 and a second end 41. Arcuate spring member 37 is disposed directly underneath pivot arm 31 and is connected to pivot arm 31 at a junction point 42. Junction point 42 is located at the approximate midpoint between first end 33 and second end 35 as well as the approximate midpoint between first end 39 and second end 41. First end 33 of pivot arm 31 and first end 39 of spring member 37 terminate to form a socket 43. Socket 43 is sized and shaped to be directly mounted on cylindrical shaft 21 of bottom member 17, thereby hingedly interconnecting top member 19 to bottom member 17. As such, top member 19 is capable of being pivoted up and down relative to bottom member 17 about the longitudinal axis of shaft 21.

Second end 35 of top member 19 is shaped to include a recess 45. Recess 45 is sized and shaped to enable needle block assembly 15 to be slidably mounted therewithin, as will be described in detail below.

Figure 5:
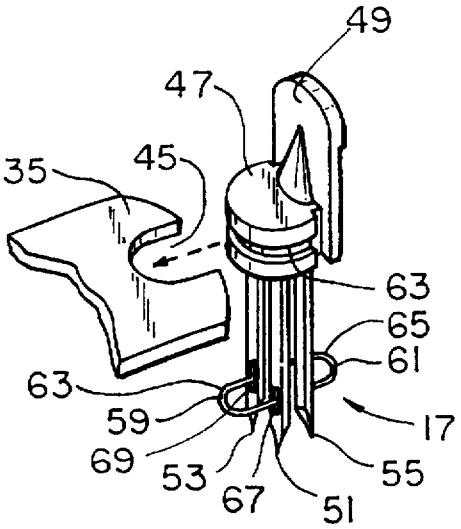
FIG. 5 is a partial perspective view of the button attaching device shown in FIG. 1.
Figure 8:
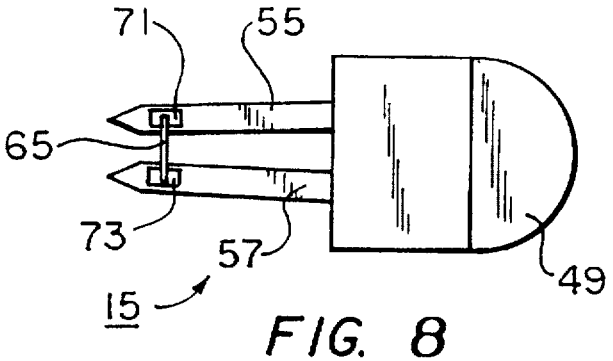
FIG. 8 is a enlarged side view of the needle block assembly shown in FIG. 4.
Figure 9:
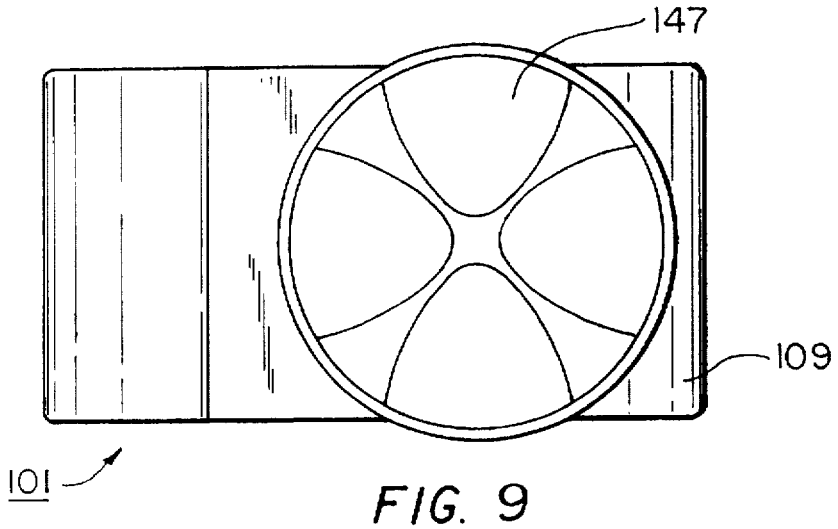
FIG. 9 is a top plan view of a second embodiment of a button attaching device constructed according to this invention for attaching a button to a piece of material.
Figure 10:
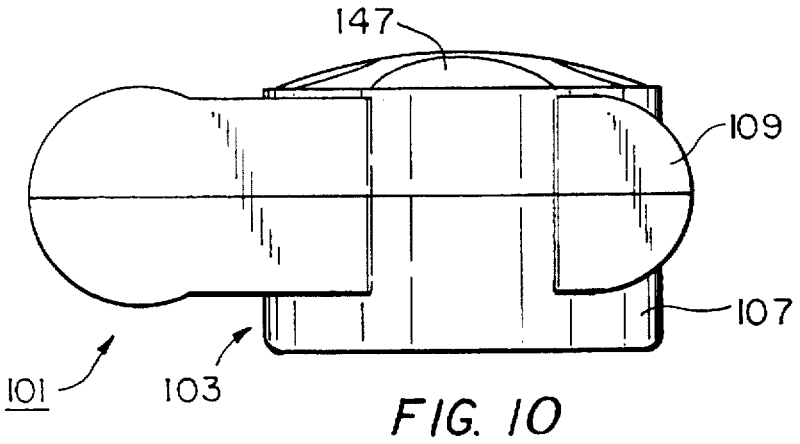
FIG. 10 is a side view of the button attaching device shown in FIG. 9.
Figure 11:
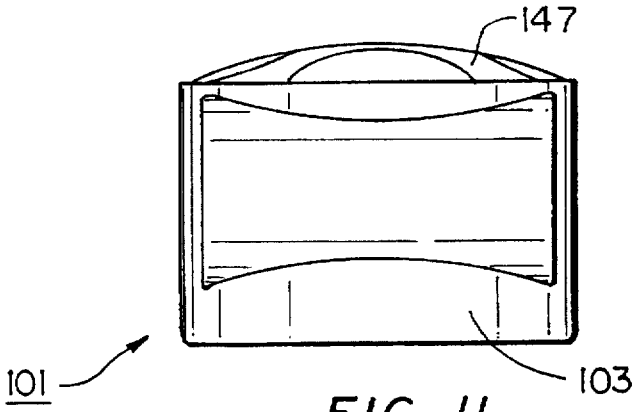
FIG. 11 is a right end view of the button attaching device shown in FIG. 9.
Figure 12:
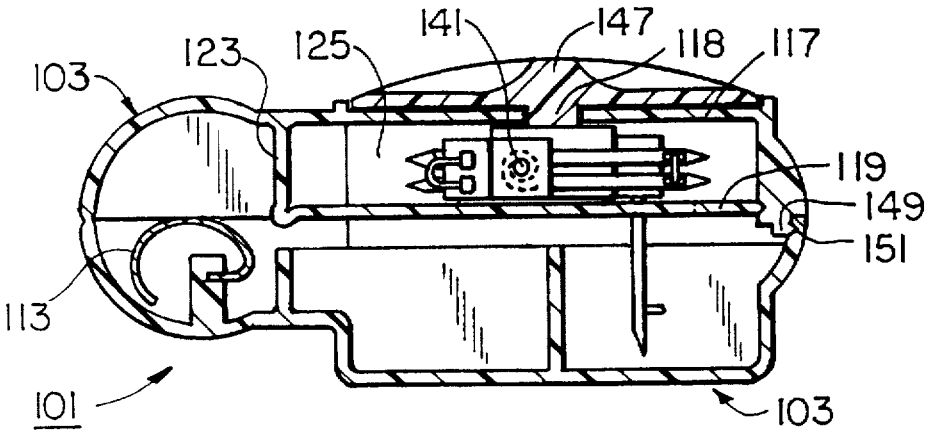
FIG. 12 is a section view of the button attaching device shown in FIG. 10, the button attaching device being shown in the closed position.

Referring now to FIGS. 5 and 8, needle block assembly 15 comprises a generally cylindrical needle block 47, an arcuate tab 49 integrally formed onto needle block 47, a first pair of rodless fastener dispensing needles 51 and 53, a second pair of rodless fastener dispensing needles 55 and 57 and two plastic fasteners 59 and 61. It should be noted that although the preferred embodiment is shown as having two pairs of rodless needles and two fasteners, the present invention is not limited to such a combination. For instance, needle block assembly 15 could alternatively comprise one pair of rodless needles and a single fastener. It should be also noted that first and second pairs of rodless needles 51 through 57 could be staggered vertically in pairs so that needles 51 and 53 extend down lower than needles 55 and 57 in order to make it easier for the four needles to pass through the layer of material.

Needle block 47 includes a lateral groove 63 formed along its periphery. As shown in FIG. 5, groove 63 is sized and shaped so as to enable needle block assembly 15 to be slidably mounted on first end 35 of pivot arm 31 within recess 45, thereby removably securing needle block assembly 15 onto top member 19.

Needles 51 through 57 are identical in construction and are fixedly mounted by any suitable means on needle block 47. Needle block 47 is made of elastomeric material so that needles 51, 53, 55 and 57 can flex to accommodate variations in button hole spacings. Needles 51 and 53 are biased towards each other to form an angle of about 10 degrees and needles 55 and 57 are angled towards each other in the same way so that a four holed button can be mounted thereon, if desired, and will not fall off during use. Needles 51 and through 57 may be, for example, needles such as shown and described in U.S. patent application Ser. No. 08/305,486, which is incorporated herein by reference.

Plastic fastener 59 includes a pair of feet or bars (not shown) which are connected by a filament 63. Fastener 61 is identical in construction to fastener 59 and includes a pair of feet (not shown) which are connected by a filament 65. Fasteners 59 and 61 may be, for example, fasteners such as shown in U.S. Pat. No. 5,518,162, which is incorporated herein by reference. The feet of fastener 59 are removably seated in a pair of cavities 67 and 69 in needles 51 and 53, respectively. Similarly, the feet of fastener 61 are removably seated in a pair of cavities 71 and 73 in needles 55 and 57, respectively.

Figure 7:
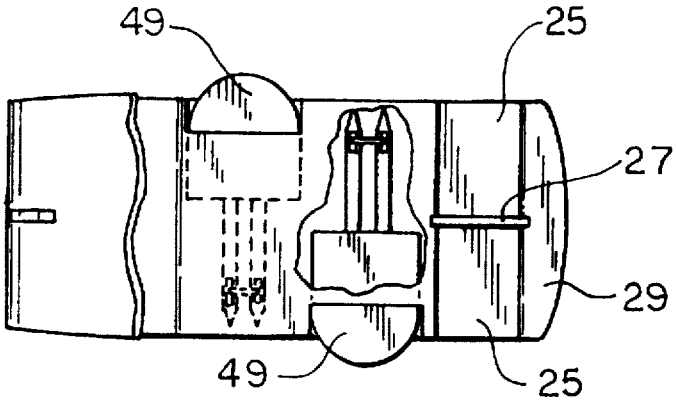
FIG. 7 is a top view, broken away in part, of the button attaching device shown in FIG. 6.

Multiple needle block assemblies 15 may be manufactured in conjunction with frame 13 to enable a single device 11 to be used to secure more than one button onto a piece of material. Accordingly, additional needle block assemblies 15 can be constructed, each assembly 15 being sized and shaped to be temporarily stored within a needle block storage compartment 29 until such a time as it is required for use. As can be seen in FIGS. 1 and 7, central portion 23 includes one or more rails 24 which are adapted to engage the lateral groove 63 of each needle block assembly 15. Needle block assemblies 15 are housed within needle block storage compartments 29 such that a portion of tab 47 extends outside of central portion 23 to enable the user to easily insert and remove assemblies 15 from central portion 23. In the preferred embodiment, central portion 23 is shown as being capable of storing two needle block storage compartments 29; However, central portion 23 may be alternatively constructed to house a different amount of assemblies 15.

To use button attaching device 11 to attach a button B to a piece of material M, top member 19 is pivoted adequately away from bottom member 17 such that piece of material M can be positioned directly upon anvil 27. The user then secures a needle block assembly 15 within recess 45 of top member 19, if an assembly has not already been mounted thereon. Button B is then positioned on needles 51 through 57 such that each needle tip extends through a hole in button B, as shown in FIG. 6.

Figure 4:
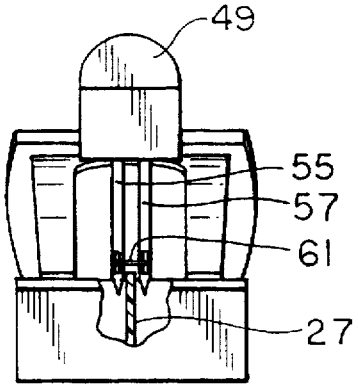
FIG. 4 is a right end view, broken away in part, of the button attaching device shown in FIG. 3.
Figure 6:
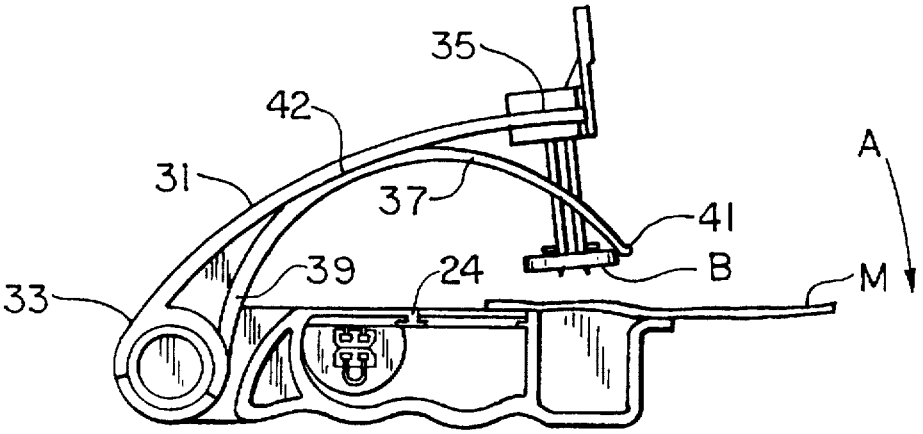
FIG. 6 is a side view of the button attaching device shown in FIG. 3, the device being shown in the open position with a button mounted on the needles and a piece of material positioned over the anvil.

Grasping button attaching device 11 with one hand, the user then squeezes top member 19 down towards bottom member 17 as shown by arrow A in FIG. 6. By applying pressure with the thumb of the user, the top member 19 is advanced downward so that the tips of needles 51 through 57 pass through piece of material M such that needles 51 and 55 extend into channel 25 on one side of anvil 27 and needles 53 and 57 extend into channel 25 on the other side of anvil 27, as shown in FIG. 4. In this manner, it should be noted that anvil 27 serves to apply the necessary upward force on piece of material M to enable needles 51 through 57 to be able to penetrate therethrough. The downward movement of top member 19 also causes second end 41 of spring member 37 to press on top of flange 29 which forces spring member 37 into a compressed position.

The tension applied on filaments 63 and 65 due its length as well as the thickness of button B and piece of material M cause the feet of fasteners 59 and 61 to pop out from their respective cavities in their respective needles. Once the feet have popped out from their respective cavities, the user stops applying a downward force on top member 19. Due to the resiliency of spring member 37, upon the termination of the downward force, spring member 37 pushes off of flange 29 and returns to its initial shape. By pushing off of flange 29, spring member 37 creates an upward force of top member 19 away from bottom member 17 which moves top member 19 in the opposite direction of arrow A, leaving button B secured to piece of material M by fasteners 59 and 61.

Referring now to FIGS. 9–16, there is shown a second embodiment of a button attaching device constructed according to the teachings of the present invention, the button attaching device being identified by reference numeral 101. As will described in detail below, button attaching device 101 can be used to secure a button B to a piece of material M in similar manner to device 11.

Button attaching device 101 is similar in most respects to button attaching device 11, the primary differences between the assembly 101 and 11 residing in the construction and shape of the frame and the means by which the individual needle block assemblies are arranged within the frame.

Button attaching device 101 comprises a generally clam-shaped frame 103 and a needle block carousel 105 which is rotably housed within frame 103.

Figure 13:
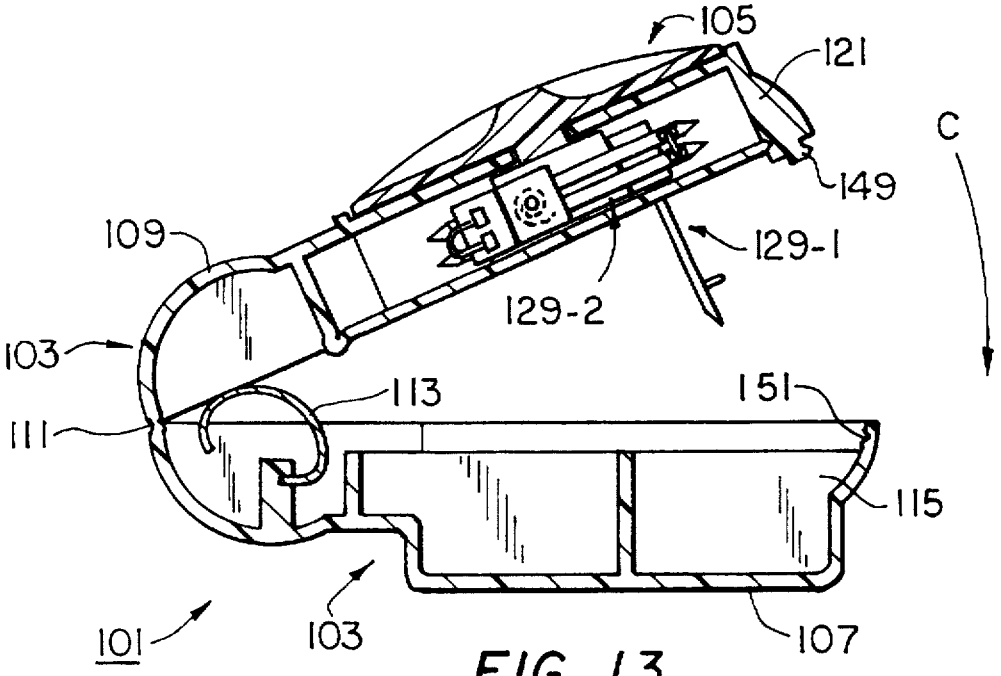
FIG. 13 is a section view of the button attaching device shown in FIG. 10, the button attaching device being shown in the open position.

Frame 103 comprises a bottom member 107 and a top member 109, top member 109 being hingedly connected to bottom member 107 at a juncture 111. Bottom member 107 includes a resilient spring 113 which presses against top member 109 so as to bias frame 103 in the open position, as shown in FIG. 13.

Bottom member 107 of frame 103 is generally hollowed out an includes an elongated anvil 115 which is similar in construction and function to anvil 23 of frame 13.

Top member 109 comprises a top wall 117, a bottom wall 119, a front wall 121 and a rear wall 123 which together define a hollowed out portion 125 therebetween. Button attaching device 101 is constructed so that the majority of needle block carousel 105 is positioned within hollowed out portion 125.

Figure 14:
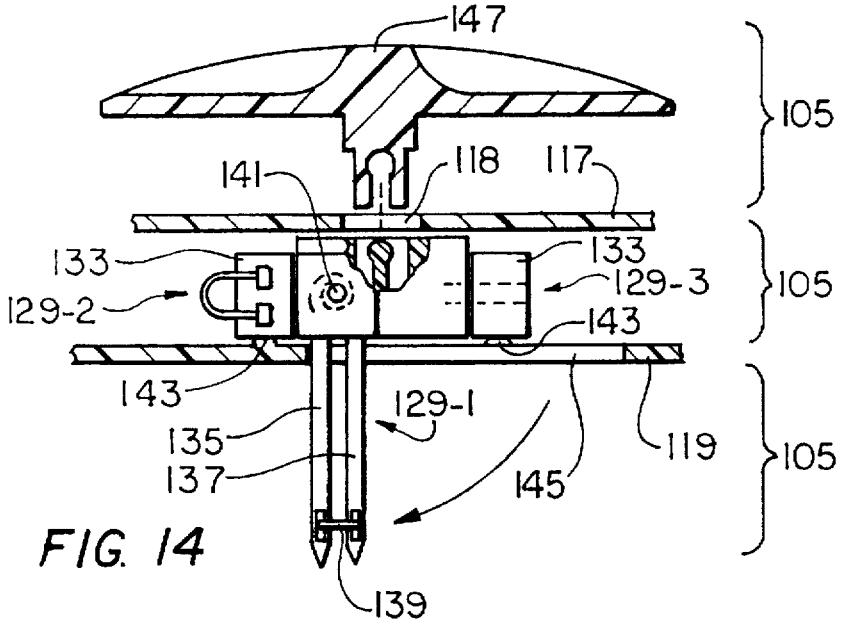
FIG. 14 is an exploded, section view of the button attaching device shown in FIG. 11, the button attaching device being shown in the open position.
Figure 15:
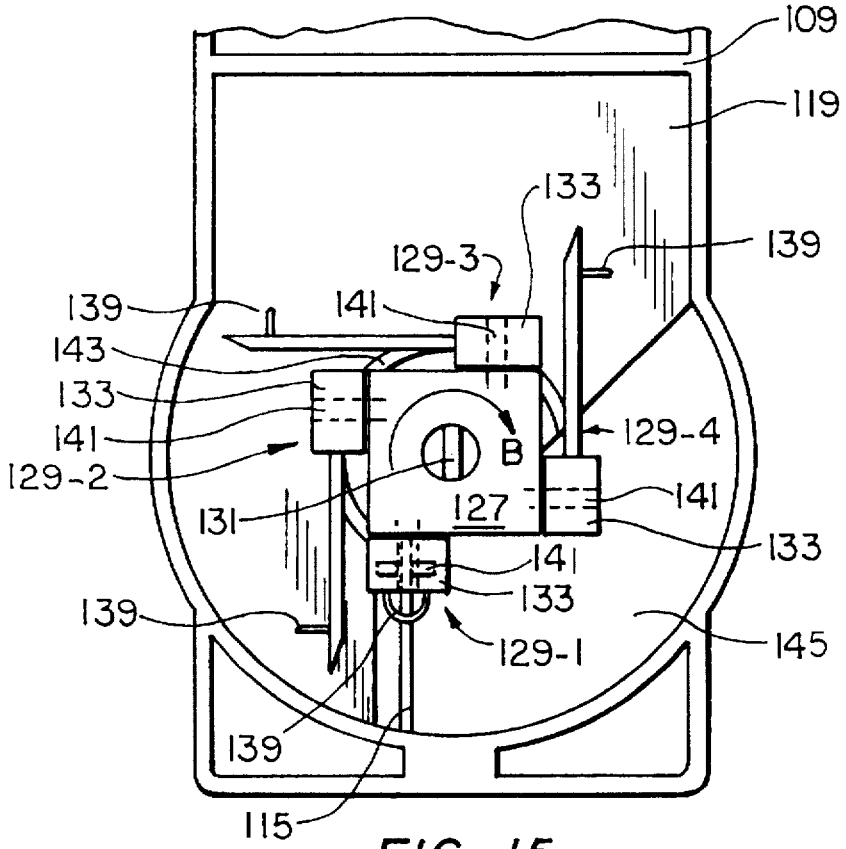
FIG. 15 is a top plan view, broken away in part, of the button attaching device shown in FIG. 9.

Referring now to FIGS. 14 and 15, needle block carousel 105 comprises a generally square shaped mounting block 127 and four needle block assemblies 129-1 through 129-4. Mounting block 127 is rotably mounted on bottom wall 119 by a screw 131 which enables block 127 to rotate clockwise relative to bottom wall 119, as shown by arrow B in FIG. 15. Each of needle block assemblies 129 includes a generally square shaped needle block 133, a pair of rodless fastener dispensing needles 135 and 137 and a plastic fastener 139.

In each of needle block assemblies 129, needles 135 and 137 are identical in construction and are fixedly mounted by any suitable means on needle block 133. Needle block 133 is made of elastomeric material so that needles 135 and 137 can flex to accommodate variations in button hole spacings. Needles 135 and 135 are biased towards each other to form an angle of about 10 degrees so that a button can be mounted thereon, if desired, and will not fall off during use. Needles 135 and through 137 may be, for example, needles such as shown and described in U.S. patent application Ser. No. 08/305,486, which is incorporated herein by reference.

Plastic fasteners 139 are identical in construction to fasteners 59 and 61 and are also used in the identical manner with rodless needles as described above. Fasteners 139 may be, for example, fasteners such as shown in U.S. Pat. No. 5,518,162, which is incorporated herein by reference.

Needle block assemblies 129 are mounted on mounting block 127 at right angles to one another, as shown in FIG. 15. Each needle block 133 is mounted on mounting block 127 by a spring pin 141 which is naturally biased so as to force the tips of needles 135 and 137 down in the vertical position towards bottom member 107, as shown by needle block assembly 129-1 in FIG. 13. However, bottom wall 119 is formed to include a raised rotation ring 143 which pushes needles 135 and 137 up and into a horizontal position, as shown by needle block assembly 129-2 in FIG. 13.

Bottom wall 119 is shaped to include an arcuate opening 145 which permits one needle block assembly 129 at a time (assembly 129-1 being shown in FIGS. 12–16) to extend down vertically through bottom wall 119 and towards anvil 115 as mounting block 127 is rotated. To facilitate rotation of mounting block 127, needle block carousel 105 includes a finger-grippable knob 147. As shown in the drawings, knob 147 may be connected in a snap-fit manner to mounting block 127 through an opening 118 in upper wall 117.

In use, device 101 can be used to secure a button B to a piece of material M in a similar manner to device 11.

Device 101 is sold in normally in the locked position with a projection 149 in top member 109 engaging a recess 151 formed in bottom member 107. The user first unlocks device 101 such that spring 131 opens frame 103 with top member 109 spaced away from bottom member 107, as shown in FIG. 13. A piece of material M is then positioned directly upon anvil 115. The user then rotates knob 147 until pair of needles 135 and 137 of one needle block assembly 129 extends vertically through bottom wall 119. Button B is then positioned on the vertical needles 135 and 137 such that each needle tip extends through a hole in button B.

Figure 16:
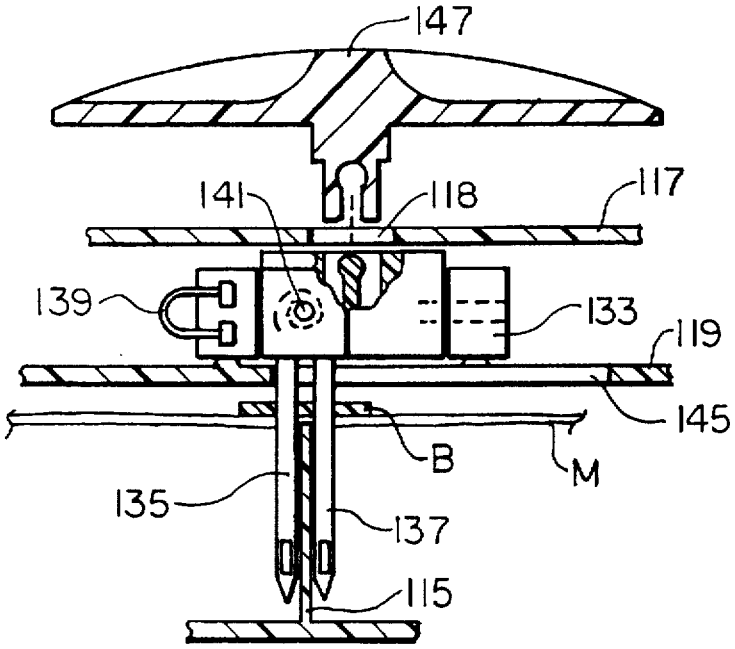
FIG. 16 is an exploded section view of the button attaching device shown in FIG. 11, the button attaching device being shown in the closed position with a button and a piece of material.

Grasping button attaching device 101 with one hand, the user then squeezes top member 109 down towards bottom member 107 as shown by arrow C in FIG. 13. By applying pressure with the thumb of the user, the top member 109 is advanced downward so that the tips of needles 135 through 137 pass through piece of material M such that needle 135 extends down on one side of anvil 115 and needle 137 extends down on the other side of anvil 115, as shown in FIG. 16. In this manner, it should be noted that anvil 115 serves to apply the necessary upward force on piece of material M to enable needles 135 through 137 to be able to penetrate therethrough.

Once the feet of fastener 139 have popped out from their respective cavities, the user stops applying a downward force on top member 109. Due to the resiliency of spring 113, upon the termination of the downward force, spring member 113 creates an upward force of top member 109 away from bottom member 107 in the opposite direction of arrow C, leaving button B secured to piece of material M by fastener 139. Further rotation of knob 147 enables the user to secure three more buttons onto a piece of material.

The embodiments shown in the present invention are intended to be merely exemplary and those skilled in the art shall be able to make numerous variations and modifications to it without departing from the spirit of the present invention. All such variations and modifications are intended to be within the scope of the present invention as defined in the appended claims.

What is claimed is:

1. A button attaching device comprising:

a top member, a bottom member, the bottom member including an anvil, the top member being hingedly connected to the bottom member, and a needle block assembly mounted on the top member, the needle block assembly comprising:

a block of material, a pair of rodless fastener dispensing needles, and a fastener having a foot at each end of a filament, each foot being removably mounted on one of the pair of rodless fastener dispensing needles.

2. The button attaching device as claimed in claim 1 wherein said needle block assembly is removably mounted on said top member.

3. The button attaching device as claimed in claim 2 wherein said needle block assembly is sized and shaped so as to fit within a needle block assembly storage compartment formed in said bottom member.

4. The button attaching device as claimed in claim 3 wherein said top member includes a spring member for biasing said top member away from said bottom member.

5. The button attaching device as claimed in claim 1 wherein a plurality of needle block assemblies are interconnected to form a needle block carousel.

6. The button attaching device as claimed in claim 5 wherein said needle block carousel is rotably mounted within a hollowed portion formed within said top member.

7. The button attaching device as claimed in claim 6 wherein said needle block carousel further comprises a mounting block rotably mounted on said top member, each of said plurality of needle block assemblies being mounted on said mounting block.

8. The button attaching device as claimed in claim 7 wherein said plurality of needle block assemblies are spring mounted on said mounting block such that the needles of each of said needle block assemblies are naturally biased down towards said bottom member.

9. The button attaching device as claimed in claim 8 wherein said needle block carousel further comprises a finger grippable knob for facilitating rotation of said mounting block.

10. The button attaching device as claimed in claim 9 wherein said bottom member includes a spring member for biasing said top member away from said bottom member.

* * * * *